US009157323B2

(12) United States Patent
Turner

(10) Patent No.: US 9,157,323 B2
(45) Date of Patent: Oct. 13, 2015

(54) OSCILLATORY ROTARY ENGINE

(76) Inventor: Mars Sterling Turner, Keller, TX (US)

( * ) Notice: Subject to any disclaimer, the term of this patent is extended or adjusted under 35 U.S.C. 154(b) by 1090 days.

(21) Appl. No.: 12/632,636

(22) Filed: Dec. 7, 2009

(65) Prior Publication Data

US 2011/0132309 A1 Jun. 9, 2011

(51) Int. Cl.

| | |
|---|---|
| ***F01C 9/00*** | (2006.01) |
| ***F02B 53/00*** | (2006.01) |
| ***F01C 20/18*** | (2006.01) |
| ***F01C 1/073*** | (2006.01) |
| ***F01C 20/26*** | (2006.01) |

(52) U.S. Cl.

CPC ..... *F01C 1/073* (2013.01); *F01C 20/26* (2013.01)

(58) Field of Classification Search

CPC ..... F01C 20/26; F01C 1/073
USPC ..... 123/241–245, 18 A, 18 R; 418/35–38
See application file for complete search history.

(56) References Cited

U.S. PATENT DOCUMENTS

| | | | | |
|---|---|---|---|---|
| 895,043 | A | 8/1908 | Rossbach-Rousset | |
| 1,568,051 | A | 1/1926 | Bullington | |
| 1,665,581 | A | 4/1928 | Deny | |
| 1,712,945 | A | 5/1929 | Thannhauser | |
| 1,950,228 | A | 3/1934 | Dedieu | |
| 1,973,397 | A | 9/1934 | Stromberg | |
| 2,092,254 | A | 9/1937 | Homer | |
| 3,670,705 | A * | 6/1972 | Saito | 418/36 |
| 3,702,746 | A | 11/1972 | Parmerlee | |
| 3,744,938 | A | 7/1973 | Matvey | |
| 3,758,228 | A * | 9/1973 | Post | 415/153.1 |
| 3,781,146 | A * | 12/1973 | Bates | 418/6 |
| 3,909,162 | A * | 9/1975 | Nutku | 418/34 |
| 4,683,852 | A | 8/1987 | Kypreos-Pantazis | |
| 4,795,012 | A * | 1/1989 | Durum | 464/99 |
| 5,125,379 | A * | 6/1992 | Linville | 123/221 |
| 5,192,201 | A * | 3/1993 | Beben | 418/38 |
| 5,537,973 | A | 7/1996 | Wittry | |
| 5,622,149 | A | 4/1997 | Wittry | |

(Continued)

FOREIGN PATENT DOCUMENTS

WO 03/008764 A1 1/2003

OTHER PUBLICATIONS

Related U.S. Appl. No. 10/818,864, filed Apr. 6, 2004; Inventor: Mars Sterling Turner.

(Continued)

*Primary Examiner* — Kenneth Bomberg
*Assistant Examiner* — Paolo Isada
(74) *Attorney, Agent, or Firm* — Holland & Hart LLP

(57) ABSTRACT

An oscillatory rotary engine comprising a toroidal housing having an intake port and an exhaust port. The housing supports an output shaft and a plurality of stacked rotors are disposed within the housing and coupled to the output shaft. Each rotor includes a plurality of pistons disposed in spaced relation to each other about a circumference of the rotor. A resilient coupler connects the rotors to the output shaft. Preferably, the coupler comprises a plurality of nested spiral cuts extending through the rotor. Each piston may include a pawl that is operative to engage ratchets located around the housing, thereby allowing rotation of each rotor in only one direction. The oscillatory rotary engine may further include a compression bypass port that is operative to relieve intake air pressure during compression, whereby the engine has a compression ratio that is less than its expansion ratio.

14 Claims, 5 Drawing Sheets

(56) References Cited

U.S. PATENT DOCUMENTS

| | | | | |
|---|---|---|---|---|
| 6,164,263 | A | 12/2000 | Saint-Hilaire et al. | |
| 6,293,775 | B1 | 9/2001 | Bakhtine | |
| 6,457,451 | B1 * | 10/2002 | Sakita | 123/245 |
| 6,739,307 | B2 * | 5/2004 | Morgado | 123/245 |
| 6,899,075 | B2 * | 5/2005 | Saint-Hilaire et al. | 123/241 |
| 7,182,061 | B2 * | 2/2007 | Georgescu | 123/245 |
| 7,631,632 | B2 * | 12/2009 | Arov | 123/241 |
| 2005/0217636 | A1 * | 10/2005 | Turner | 123/245 |
| 2009/0007882 | A1 * | 1/2009 | Lents et al. | 123/200 |

OTHER PUBLICATIONS

Angel Labs. Downloaded at http://www.angellabsllc.com on Mar. 10, 2010.

Rotoblock. Downloaded at http://www.rotoblock.com on Mar. 10, 2010.

International Search Report mailed Jul. 27, 2011 for Application No. PCT/US2010/058207, 9 pp.

* cited by examiner

OSCILLATORY ROTARY ENGINE

TECHNICAL FIELD

The present disclosure generally pertains to an internal or external combustion or expansion engine for use in numerous applications, including motor vehicles. More specifically it pertains to engines of the oscillatory rotary type.

BACKGROUND

A popular rotary piston engine is the oscillatory rotating arrangement which employs a plurality of rotors with interleaved pistons, or vanes, around the center of rotation. By changing the angular velocity of the rotors, an oscillatory movement is superimposed on their uniform rotation, thus modifying the volume of the energy chambers defined by each pair of adjacent pistons and the inner surface of the engine housing.

The number of pistons on each rotor is equal to the number of contraction and expansion regions of the housing in an oscillatory rotating engine. As each chamber goes through an expulsion stroke it travels or rotates through the spacing between the expulsion port and the intake port. In the spacing the chamber experiences conditions which produce a sort of short non-actuation period where it can neither expand nor contract. The two rotors defining the actuation of the chamber translates these non-actuation characteristics to all chambers exclusively defined by the two rotors. In all cases, the number of chambers that experience non-continuous actuation as each chamber passes the port spacing is equal to the number of individual vanes on each rotor.

There are many examples of oscillatory rotating engines, such as disclosed in, for example, U.S. Pat. Nos. 1,973,397; 6,293,775; and 3,744,938, the disclosures of which are all incorporated herein by reference as well as my earlier U.S. patent application Ser. No. 10/818,864, filed Apr. 6, 2004, the disclosure of which is hereby incorporated by reference in its entirety. The design particulars of previous oscillatory rotating engines involve scissor action where all alternate chambers actuate diametrically opposed strokes. The non-actuation period of the two rotors makes all chambers stop actuating for a time between every single stroke, producing coupling harmonics that require robust and sophisticated gears and flywheels. Furthermore, continuous combustion is difficult to achieve in previous designs without transfer ports.

Another type of rotary engine of interest is the quasi-turbine (Qurbine) described in, for example, U.S. Pat. Nos. 6,164,263 and 6,899,075, the disclosures of which are incorporated herein by reference. The Qurbine includes an assembly of four carriages supporting the pivots of four pivoting blades forming a variable-shape rotor. This rotor rolls like a roller bearing on the interior surface of an obround housing. During rotation, the rotor pivoting blades align alternatively in a lozenge and a square configuration. A central shaft is added and driven by the blades through an arrangement of mechanical arms.

High frequency opening and closing ports of high pressure vapor often produce large shock wave harmonics, making vibration tolerance a major limiting factor for power density and gear train design. Previous rotary engines often use sophisticated gear and crank actuation mechanisms where turning the shaft induces an oscillatory rotary movement. These mechanisms often more than double the size and weight of the total engine.

Accordingly, it will be appreciated by those of ordinary skill in the art that there is a need for an improved oscillatory rotating engine that simplifies the transfer of torque to the output shaft while coming closer to a continuous combustion engine.

SUMMARY

The disclosed oscillatory rotary engine is a continuous internal combustion engine using the entire chamber torus with the use of a plurality of rotors, preferably at least three rotors. Also, a resilient coupler is disclosed that is axially force stabilized through the use of elastic members. The elastic members include springs, such as spiral springs, such as torsion springs, compression springs, and the like. Preferably, the coupling mechanism comprises a flat spiral spring as the elastic member that attaches each piston to the output shaft. The disclosed oscillatory rotary engine employs a simple and compact pawl and ratchet arrangement in order to control directionality of the rotors. The disclosed oscillatory rotary engine may use the Atkinson combustion cycle by using a compression bypass port where part of the compression stroke does not compress the gas in the chamber and where some of the gas in the chamber that is in the compression stroke is exhausted or put back into the intake stream resulting in an expansion ratio that is higher than the compression ratio.

In an exemplary embodiment, the oscillatory rotary engine comprises a toroidal housing having an intake port and an exhaust port. The housing supports an output shaft and a plurality of stacked rotors are disposed within the housing and coupled to the output shaft. Each rotor includes a plurality of pistons disposed in spaced relation to each other about a circumference of the rotor.

A resilient coupler connects the rotors to the output shaft. The resilient coupler may be a torsion spring, for example. The resilient coupler also may be integrally formed with the rotor in the form of a spiral cut extending through the rotor, and concentric with the output shaft. Preferably, the coupler comprises a plurality of nested spiral cuts extending through the rotor.

Each piston on each of the rotors may include a pawl that is operative to engage ratchets located around the housing, thereby allowing rotation of each rotor in only one direction. Preferably, the pawls are radially biased toward the ratchets.

The oscillatory rotary engine may further include a compression bypass port that is operative to relieve intake air pressure during compression, whereby the engine has a compression ratio that is less than its expansion ratio, thereby making use of the Atkinson combustion cycle. A valve that opens and closes the compression bypass port may be used to control the amount and timing of pressure relief.

Also, contemplated herein are improvements to existing oscillatory rotary engines. The improvements include a pawl disposed on at least one of each rotor's pistons. Each pawl being operative to engage ratchets located in the engine's housing thereby allowing rotation of each rotor in only one direction. The improvements also include a resilient coupling between the engine's output shaft and disc shaped rotors. The resilient coupling being a torsion spring in the form of a plurality of nested spiral cuts extending through the rotor.

DETAILED DESCRIPTION

The present application is directed to an oscillatory rotary engine. However, it is contemplated that the teachings of the disclosure may be applied to compressors and pumps as well. Moreover, while the oscillatory rotary engine is described in the exemplary embodiments as an internal combustion engine, the engine may also operate as an external combustion engine.

Figure 1:
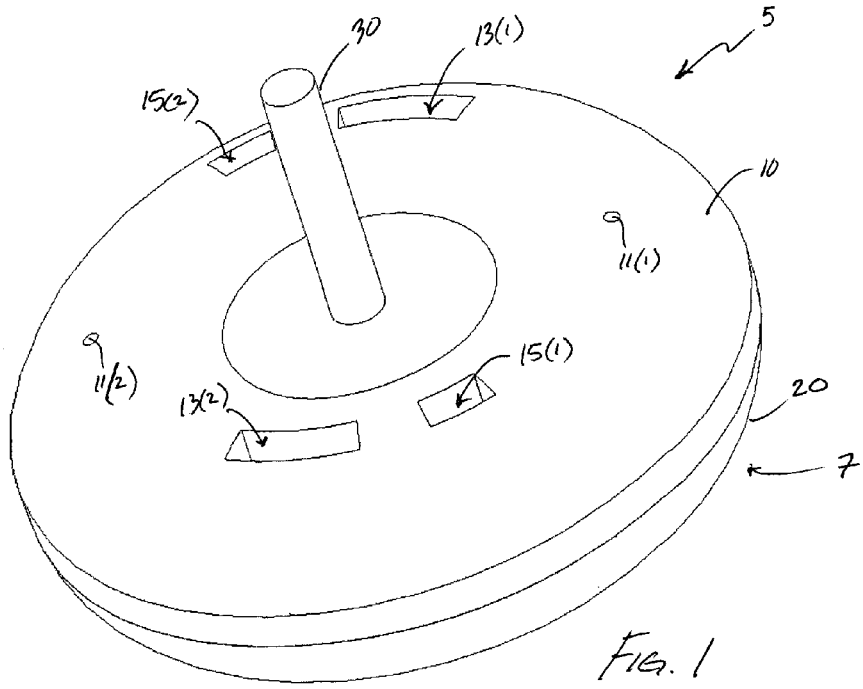
FIG. 1 is a perspective view of an oscillatory rotary engine according to an exemplary embodiment.

FIG. 1 illustrates an exemplary embodiment of the oscillatory rotary engine. Engine 5 is comprised of a housing 7 that includes upper housing 10 and lower housing 20. Extending axially from the housing is an output shaft 30, which may be coupled to a vehicle, pump, compressor, generator, or the like. Upper housing 10 includes diametrically opposed intake ports 13(1) and 13(2). Upper housing 10 also includes diametrically opposed exhaust ports 15(1) and 15(2). While the intake and exhaust ports are shown here as being diametrically opposed, the ports may vary in their location depending on the exact timing requirements desired. For instance, by varying the number size and location of the ports, the theoretical operating cycle of the engine may be varied. For example and without limitation, the oscillatory rotary engine may be operated as a Brayton cycle, Atkinson cycle, Miller cycle, Otto cycle, or diesel cycle. Furthermore, the induction of an air fuel mixture through intake ports 13(1) and 13(2) may be effected by various fuel control devices that are known in the art. For instance, intake ports 13(1) and 13(2) may be coupled to a carburetor, or preferably a closed loop electronically controlled fuel injection system.

In the case where combustion ignition is desired, upper housing 10 also may include ignition ports 11(1) and 11(2) to facilitate the introduction of a spark for igniting the inducted fuel/air mixture. For example, ports 11(1) and 11(2) may be configured to accept standard sparkplugs, which in turn are energized by a standard ignition system such as is known in the art.

Figure 2:
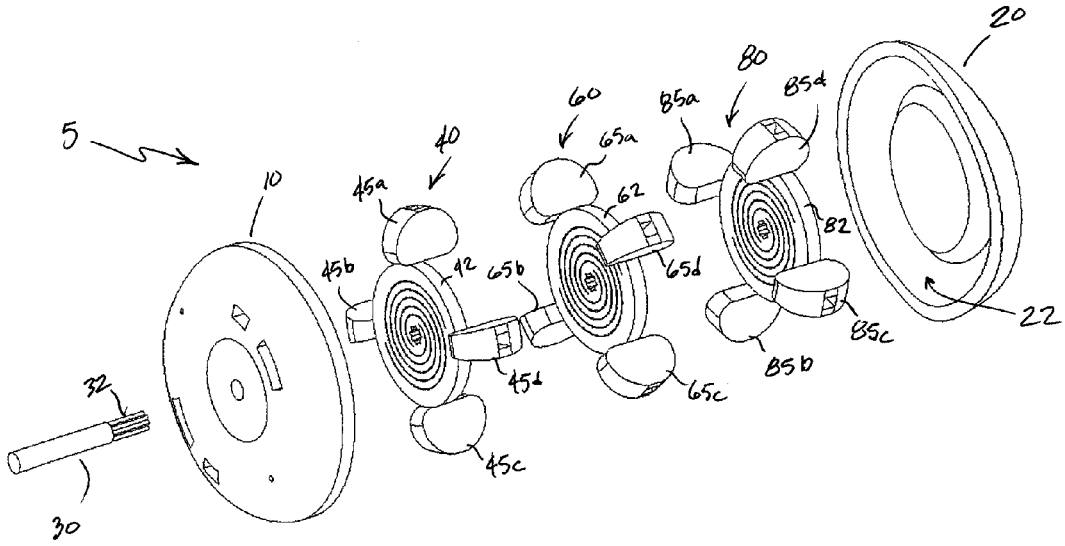
FIG. 2 is an exploded perspective view of the oscillatory rotary engine shown in FIG. 1.

With further reference to FIG. 2, it can be appreciated that upper and lower housings, 10 and 20 respectively, when assembled form a toroidal cylinder 22. Located within the housing is a plurality of rotors. In this embodiment three rotors (40, 60, and 80) are disposed within the housing. Each rotor is coupled to output shaft 30 via a resilient coupler. In this case output shaft 30 includes a plurality of splines 32 which engage each rotor. It should be understood that, while a single torus housing is described herein, multiple torus housings along with associated rotors may be coupled to the same shaft. Furthermore, the torus housings may be rotated relative to each other so that the intake and exhaust ports of the respective housings are also rotated, whereby the timing of combustion in the housings occurs at different points in the shaft's rotation. Alternatively, the rotors of one torus may be shifted on the shaft relative to the rotors of a second torus, for example. For instance, shifting the rotors of a second torus by 7.5 degrees would put the combustion ignition of the two toruses in an alternating mode. In the case where three toruses are connected to a single shaft, the rotors could be shifted by 5 degrees.

Figure 3:
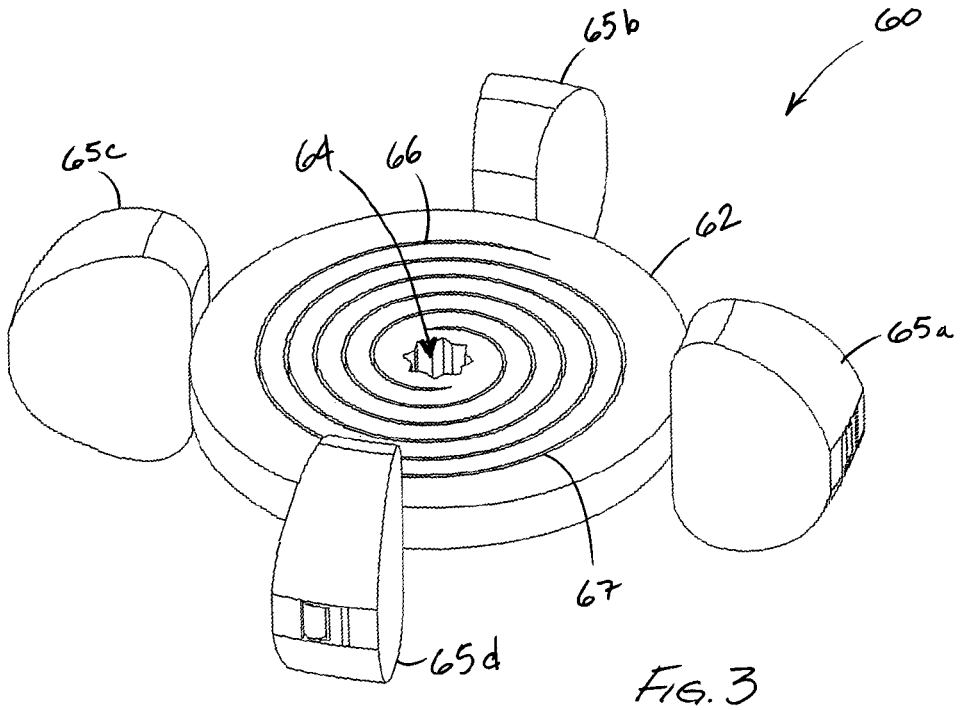
FIG. 3 is an enlarged perspective view of one of the engine rotors.

Each rotor comprises a plurality of pistons and a rotor disk. For example, as may be best appreciated in FIG. 3, rotor 60 includes rotor disk 62 and a plurality of pistons 65*a*-65*d* disposed therearound. In this case, the pistons are shown to be in equally spaced relation to each other. However, the piston spacing may vary. The pistons are preferably comprised of a metal material, such as for example, 362 maraging steel. The rotor disk 62 includes resilient coupler means in the form of a pair of nested spiral cuts 66 and 67. At least two spiral cuts are preferred in order to prevent potential axially destabilizing forces. Other increments of spiral cuts may be used, as well. Preferably, the rotor disk is comprised of metal, such as for example, A-286 precipitation hardened spring steel.

Located at the center of the resilient coupler is a splined aperture sized and configured for receiving the splined section 32 of the output shaft 30. Accordingly, combustion pressure acting against the faces of pistons 65*a*-65*d* translates into torque through rotor disk 62, which in turn exerts a torque on output shaft 30. The resilient coupler allows the adjacent pistons to move towards and away from each other while still coupled to output shaft 30. This relative piston movement allows for intake, compression, expansion, and exhaust strokes as more thoroughly described below. In this case, each resilient coupler means is integral with its corresponding rotor disk 62 in the form of nested spirals. However, the resilient coupler means could include a torsion spring or be in the form of a separate coupler that allows rotary displacement relative to its axis. Other coupler means may be employed, such as are known in the art, including but not limited to rubber discs, compressions springs interposed between a rotor and stator, mating plastic teeth, and the like.

Figure 4:
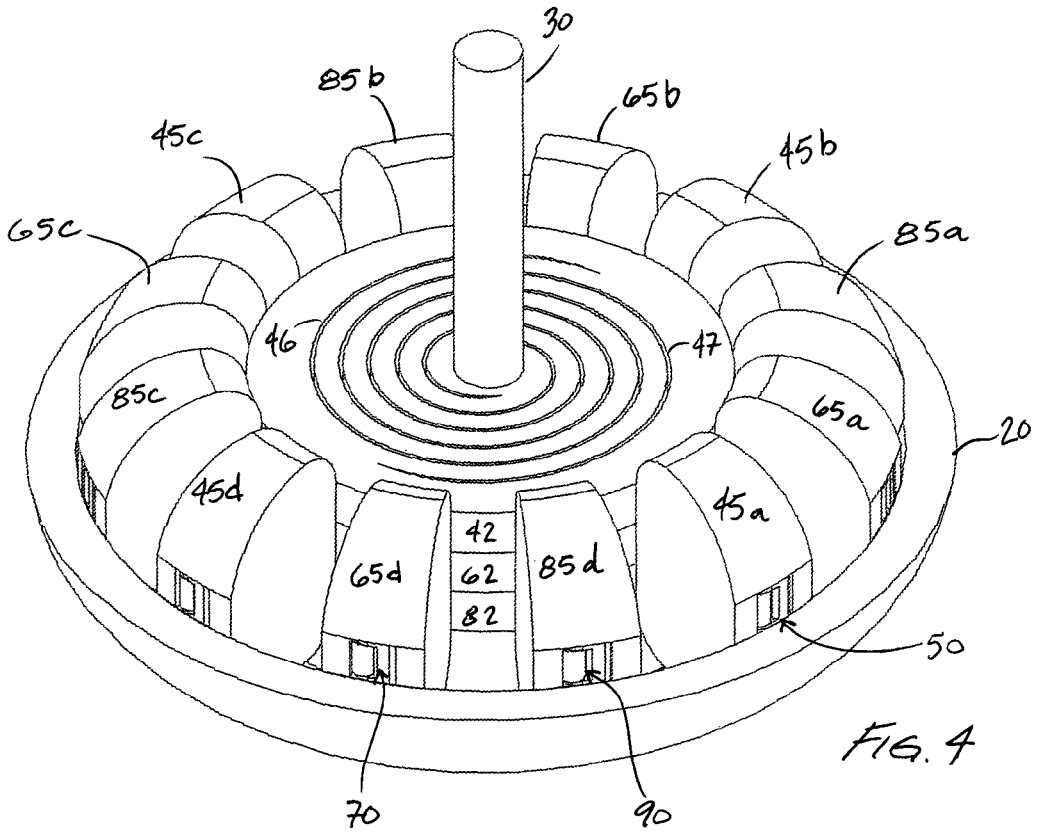
FIG. 4 is a perspective view of the oscillatory rotary engine shown in FIGS. 1 and 2 with the upper cover removed.

It can be appreciated with reference to FIG. 4 that when the rotors are stacked and disposed within housing 7, rotor discs 42, 62, and 82 are in close confronting relation to each other. Returning briefly to FIG. 2, it can be appreciated that, depending on the location of each rotor in the stack, the rotor's associated pistons may be offset axially such that all of the pistons are aligned with each other with respect to the toroidal cylinder 22. For example, the pistons disposed on rotors 40 and 80 are offset towards rotor 60. Accordingly, rotor 60 includes pistons which are centered on rotor disk 62. It should be appreciated that while the present embodiment is depicted with three rotors, other increments of rotors are contemplated. It follows, that the pistons of each rotor may need to be offset in varying amounts depending on the number of rotors employed. FIG. 4 also illustrates the alternating arrangement of each rotor's pistons. For example, piston 45*a* is adjacent to piston 65*a*, which is adjacent to piston 85*a*. In this case, the sequence 45, 65, and 85 repeats for each piston on the rotors (a, b, c, and d).

Figure 5A:
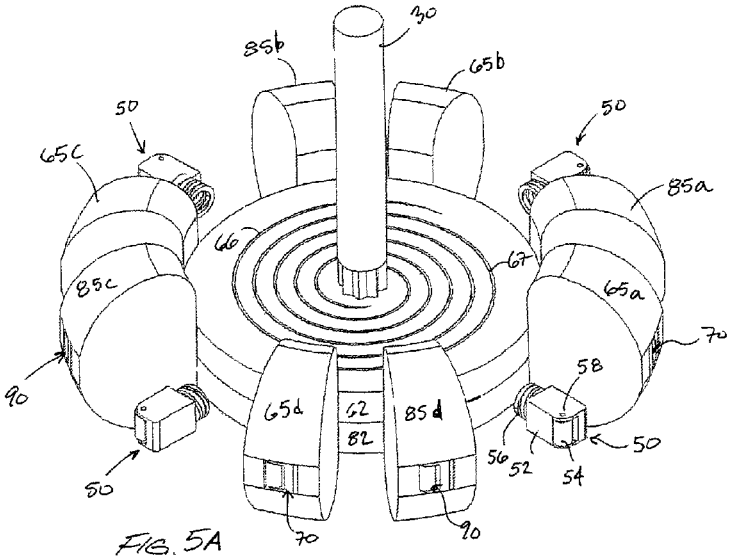
FIG. 5A is a perspective view of the oscillatory rotary engine shown in FIGS. 1, 2, and 4 with both covers and one rotor removed.

Each rotor includes a uni-directional rotation means for allowing rotation of each rotor in only one direction. For example, each piston may include a pawl, or sprag, assembly (50, 70, or 90) in order to direct the rotation of the engine in a single direction, which is explained more thoroughly below. In FIG. 5, rotor 40 is hidden in order to better illustrate the pawl assemblies. Rotor 40 includes a pawl assembly 50 located in the outermost surface of each piston. Each pawl assembly 50 includes a pawl housing 52, which houses a roller 54 that is retained within housing 52 by a pin 58. Pawl 50 is radially biased, or urged, towards the outer circumference of the toroidal cylinder 22 by a compression spring 56. Pawl assemblies 70 and 90 are of similar construction to that of pawl assembly 50, explained above. While the pawl assemblies are shown as a spring loaded housing and roller, other ratcheting arrangements may be used.

Figure 5B:
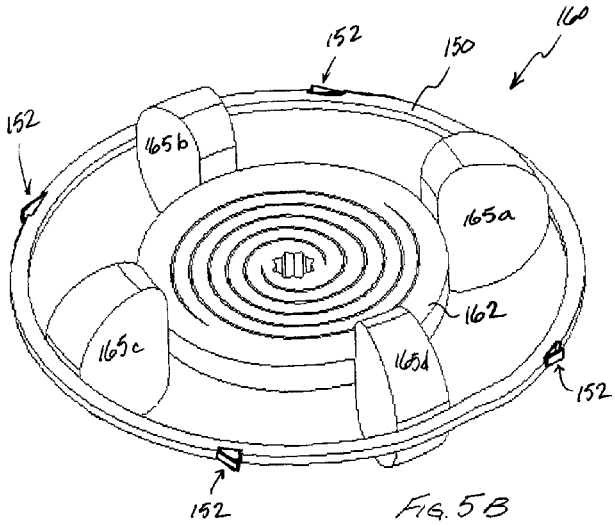
FIG. 5B is a perspective view of an alternative rotor construction.

FIG. 5B illustrates an alternative construction for the rotors including another example of uni-directional rotation means. In this case, rotor 160 includes a rotor disk 162 and pistons 165*a*-165*d* similar to those shown in FIG. 5A. However, rotor 162 includes sprag ring 150. Sprag ring 150 includes a plurality of sprags, or pawls 152 that may be fastened to ring 150 by welding or crimping, for example. Each sprag 152 is, in this case, formed of a spring steel material and positioned on sprag ring 150 such that it is biased toward the torus housing. As the rotor rotates in the housing each sprag is operative to engage a corresponding ratchet recess, thereby preventing reverse rotation. Alternatively, sprag ring 150 may be configured as a portion of a roller clutch bearing, a cam clutch, or a sprag clutch as are known in the art. In another alternate construction, ring 150 may include gear teeth that connect to directional gearing located co-axially to the engine's torus.

Figure 6:
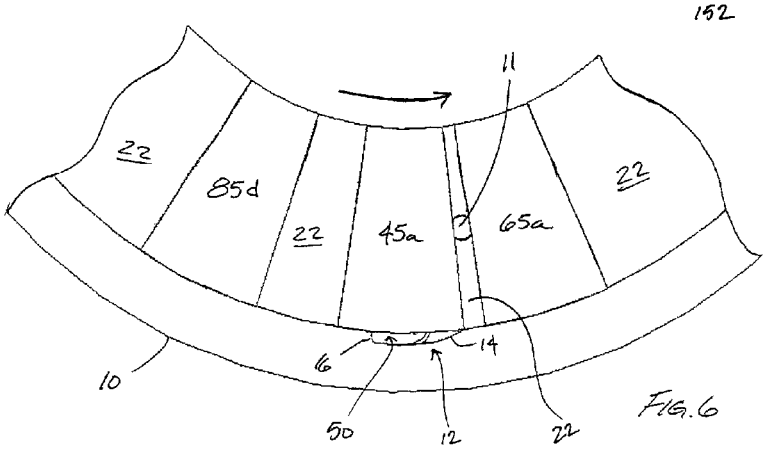
FIG. 6 is an enlarged partial plan view of the upper cover as viewed from the toroidal cylinder.

FIG. 6 illustrates an enlarged portion of toroidal cylinder 22 with pistons 45*a* and 65*a* in a position just prior to ignition. Accordingly, the air/fuel mixture between pistons 45*a* and 65*a* is compressed and once ignition is initiated through port 11 the heat release from combustion will cause the gases to expand, thereby forcing pistons 45*a* and 65*a* apart. Ratchet assembly 50 prevents piston 45*a* from rotating the wrong direction (clockwise in this case). As can be appreciated in the figure, as piston 45*a* approaches ignition port 11 (i.e. a combustion zone) pawl assembly 50 engages ratchet relief 12, which is formed in the sidewall of upper housing 10. Ratchet relief 12 includes a catch portion 16 and a ramped portion 14. Once pawl assembly 50 moves past catch portion 16 housing 52 is biased towards the ratchet relief. Accordingly, housing 52 cannot rotate backwards (clockwise). Thus, once combustion is initiated the gases can only expand towards piston 65*a* while piston 45*a* is prevented from counter-rotating. As the combustion gases expand and the rotors continue to rotate about the output shaft axis, roller 54 follows ramped portion 14 of ratchet relief 12, thereby moving pawl assembly 50 back into piston 45*a*. As each piston (for example 85*d*) approaches ratchet relief 12 the piston's associated pawl assembly engages the ratchet. In this way the oscillatory rotary engine is forced to rotate in a single direction.

Figure 7:
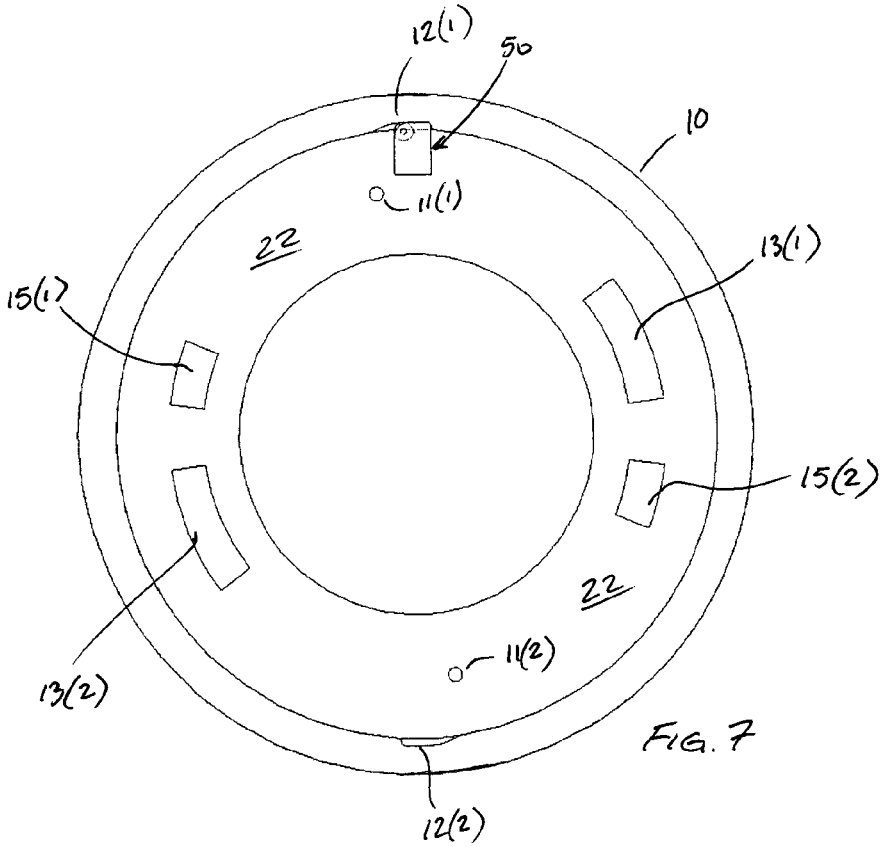
FIG. 7 is a plan view of the upper cover as viewed from the toriodal cylinder that illustrates the relative locations of the intake and exhaust ports.
Figure 8:
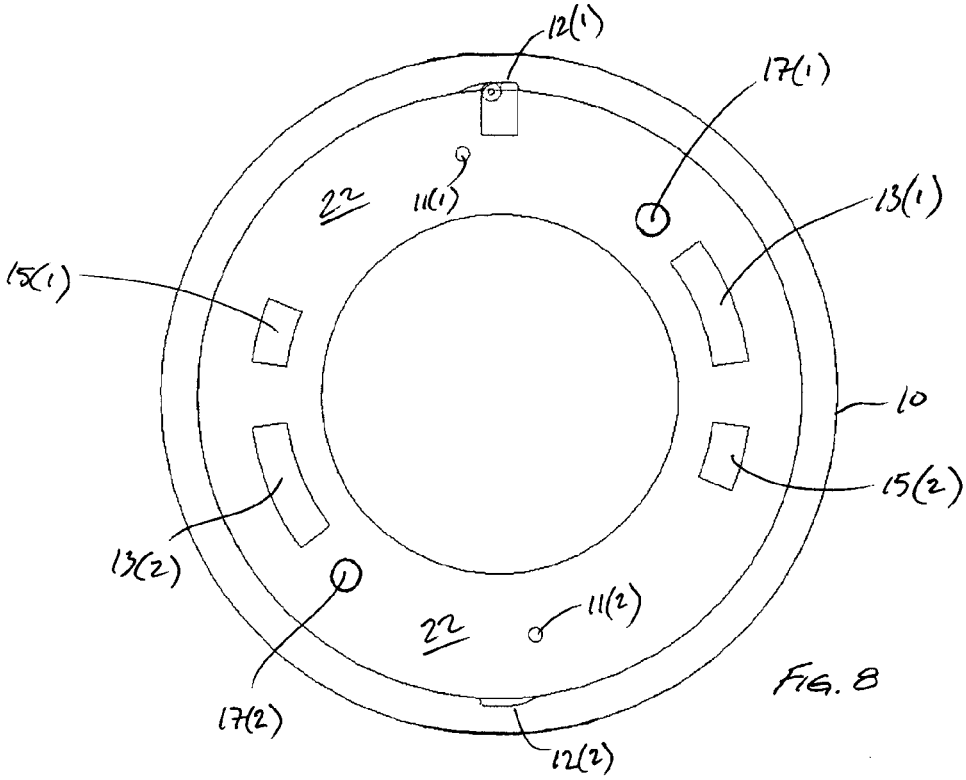
FIG. 8 is a plan view of the upper cover similar to that of FIG. 7 that illustrates the relative locations of optional compression bypass ports.

FIG. 7 illustrates the relative position of ratchet reliefs 12(1) and 12(2) with respect to the ignition, intake, and exhaust ports. Although only two combustion zones (i.e. ignition ports 11(1) and 11(2)) are shown in the figures, additional combustion zones along with accompanying intake and exhaust ports may be used depending on the number of rotors and the number of pistons employed on each rotor for a particular application. FIG. 8 illustrates an upper housing 10 including optional compression bypass means in the form of ports 17(1) and 17(2). The compression bypass ports are located relative to the intake ports such that as each pair of pistons sweeps past the intake port and bypass compression port during the compression stroke a selected amount of intake air pressure (compression) is relieved. Therefore, the compression ratio of the engine is less than its expansion ratio, consistent with the Atkinson and Miller cycles, which are well known in the art. Preferably, the compression bypass ports 17(1) and 17(2) are connected to intake passageways so that the intake air can be recycled. Alternatively, the bypass ports may be connected to the exhaust passageways or vented to atmosphere. Ports 17(1) and 17(2) may have associated valves to selectively control the timing of compression bypass. The compression bypass means may also be in the form of an enlarged intake port. The intake port is sized and positioned such that as the piston pair begins to compress, the intake port is still in communication with the chamber between the piston pair. Thus, intake air pressure (compression) is relieved back into the intake passageway.

FIGS. 9-14 illustrate the strokes made by the rotor pistons during operation of the oscillatory rotary engine. Each stroke is illustrated with reference to a single pair of pistons 45*a* and 65*a*. It should be appreciated, however, that each subsequent piston pair follows the same sequence of events. The region of interest in each figure is denoted by the tail of arrow "T" which 275 indicates the direction of rotation.

Figure 9:
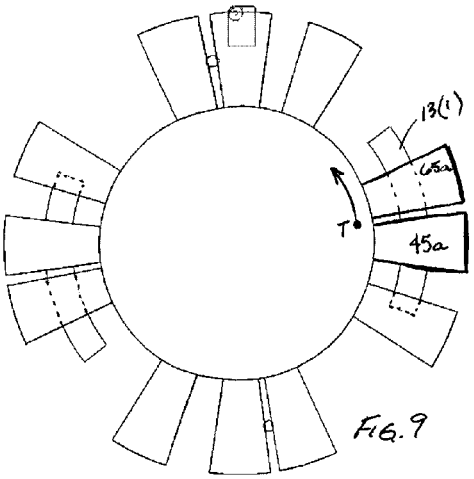
FIGS. 9-14 are schematic diagrams illustrating the strokes made by the rotor pistons during operation of the oscillatory rotary engine.

Beginning with FIG. 9, piston pair 45*a* and 65*a* is beginning the intake stroke. During intake, as the rotors rotate, pistons 45*a* and 65*a* begin to separate, or diverge, from one another, thereby increasing the volume between the pistons resulting in a low pressure region which draws intake air through intake port 13(1).

Figure 10:
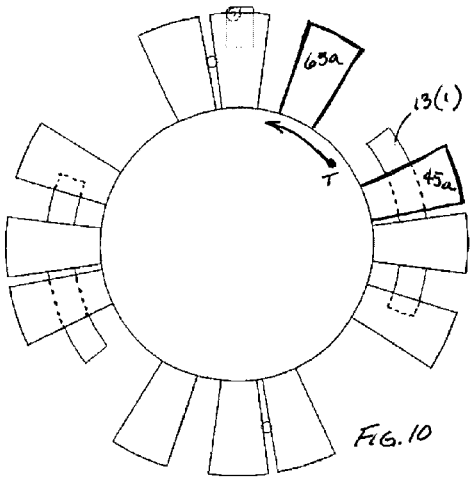

FIG. 10 illustrates the intake stroke approximately halfway through the process where piston 45*a* has begun to sweep over intake port 13(1). As the rotors continue to rotate, pistons 45*a* and 65*a* begin to come together, or converge, during which time piston 45*a* clears intake port 13(1) and the compression stroke begins.

Figure 11:
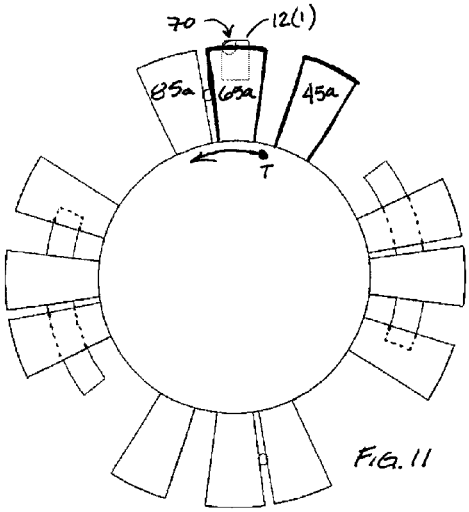
Figure 14:
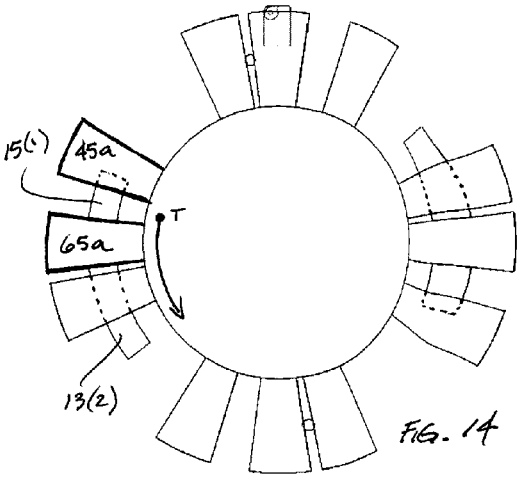

FIG. 11 illustrates the compression stroke approximately midway through the stroke. It can be appreciated in FIG. 11 that pawl assembly 70 of piston 65*a* has engaged ratchet relief 12(1). As piston pair 65*a* and 45*a* near completion of the compression stroke, piston 85*a* is propelled away from piston 65*a*, which is retained in position by pawl assembly 70.

Figure 12:
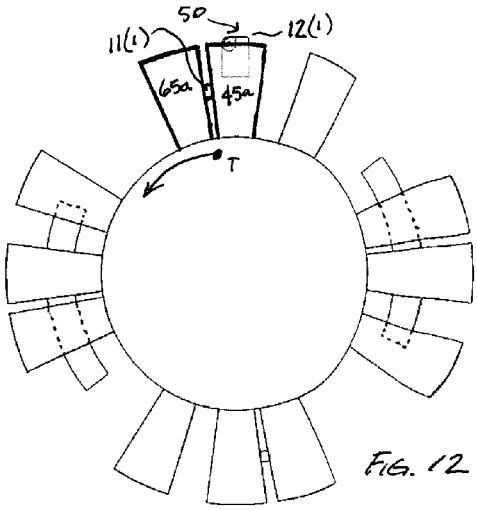
Figure 13:
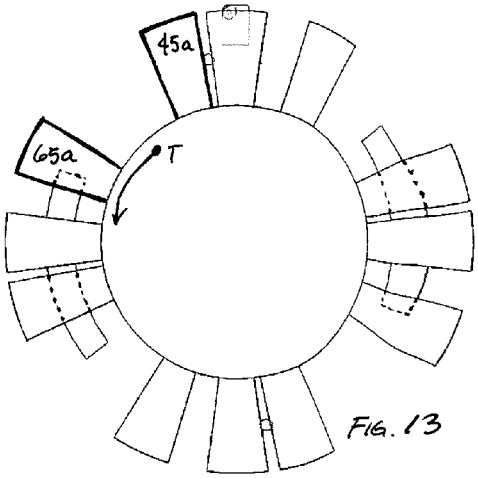

Moving to FIG. 12, pistons 45*a* and 65*a* have completed the compression stroke and are in position around ignition port 11(1). Also, pawl assembly 50 has engaged ratchet relief 12(1) so that once the initiation of combustion occurs piston 45*a* is prevented from rotating clockwise. The energy of the power stroke is exerted against both pistons 45*a* and 65*a*. However, only piston 65*a* can move away from the expanding combustion gases so that piston 65*a* expands away from piston 45*a* in the power stroke as shown in FIG. 13. It can be understood that each expansion stroke provides the energy necessary for adjacent compression strokes through a scissor action between interleaved pistons corresponding to perpendicular chambers.

Finally, in FIG. 14, the pistons again converge as they approach exhaust port 15(1) thereby compressing and exhausting combustion gases through exhaust port 15(1). As the rotors rotate further piston pair 45*a* and 65*a* begin the sequence again as they rotate over intake port 13(2). From the above description and with reference to the drawings it can be appreciated that each piston pair sequences through two full cycles for each revolution of the output shaft. Thus, the entire torus chamber spacing is used and at least one chamber (piston pair) is in combustion/expansion at all times.

Accordingly, the oscillatory rotary engine has been described with some degree of particularity directed to the exemplary embodiments thereof. It should be appreciated that the contemplated oscillatory rotary engine is defined by the following claims construed in light of the prior art so that modifications or changes may be made to the exemplary embodiments of the oscillatory rotary engine without departing from the concepts contained herein.

I claim:

1. An oscillatory rotary engine, comprising:

a toroidal housing having an intake port and an exhaust port;

ratchets located around the housing;

an output shaft; and a plurality of stacked rotors disposed within said housing and coupled to said output shaft, each said rotor including:

a rotor disk;

a plurality of pistons disposed about a circumference of each rotor disk;

at least one of the plurality of pistons including a pawl;

a center aperture defined by each rotor disk; and a resilient coupler of the rotor disk connecting the rotor disk to the center aperture and each of said plurality of stacked rotors is connected to said output shaft by the center aperture;

said resilient coupler includes a spiral shaped cut extending through at least one of said plurality of stacked rotors and having a common center with said center aperture;

wherein includes the pawl is operative to engage the ratchets thereby allowing rotation of each rotor disk in only one direction.

2. The oscillatory rotary engine of claim 1 wherein said pawls are radially biased toward said ratchets relative to said output shaft.

3. The oscillatory rotary engine of claim 1 further comprising a compression bypass port operative to relieve intake air pressure during compression, whereby the engine has a compression ratio that is less than its expansion ratio.

4. The oscillatory rotary engine of claim 3 including a valve that opens and closes said compression bypass port.

5. The oscillatory rotary engine of claim 1 wherein said resilient coupler further comprises a torsion spring.

6. The oscillatory rotary engine of claim 1 including a plurality of nested spiral cuts extending through said rotor disk.

7. An oscillatory rotary engine, comprising:

a housing including a toroidal cylinder and having a pair of diametrically opposed intake ports and a pair of diametrically opposed exhaust ports;

ratchets located around the housing;

a splined output shaft; and at least three stacked disk shaped rotors disposed within said housing and coupled to said output shaft, each said rotor including:

a rotor disk;

a splined center aperture defined by each rotor disk;

a plurality of pistons disposed about the circumference of said rotor disk and residing within said toroidal cylinder; and a spiral shaped cut extending through at least one of said plurality of stacked rotors and having a common center with said output shaft resiliently connecting said rotor disk to said output shaft; and at least one of the pistons includes a pawl;

wherein the pawl is operative to engage the ratchets thereby allowing rotation of each rotor disk in only one direction.

8. The oscillatory rotary engine of claim 7, including three rotors, each having four pistons.

9. The oscillatory rotary engine of claim 8 further comprising at least one of a port or a valve configured to relieve intake air pressure during compression, whereby the engine has a compression ratio that is less than its expansion ratio.

10. The oscillatory rotary engine of claim 9 wherein said means for relieving intake air pressure during compression includes a valve for selectively relieving the intake air pressure.

11. In an oscillatory rotary engine including a toroidal housing having an intake port and an exhaust port, an output shaft, and a plurality of stacked rotors disposed in said housing, wherein each of said plurality of stacked rotors includes a plurality of pistons, the improvement comprising:

a pawl disposed in each of said pistons, each of said pawls being operative to engage ratchets located in the housing thereby allowing rotation of each rotor disk of the staked rotors in only one direction; and a spiral shaped cut extending through at least one of said plurality of stacked rotors and having a common center with said output shaft configured to provide a resilient coupling between said shaft and said at least one of said plurality of stacked rotors.

12. The improvement according to claim 11 wherein said pawls are radially biased towards said ratchets relative to a longitudinal axis of said output shaft.

13. The improvement of claim 11 wherein said resilient coupler further comprises a torsion spring.

14. The improvement of claim 11 including a plurality of nested spiral cuts extending through said rotor disk.

* * * * *